US007237461B1

(12) United States Patent
Wu

(10) Patent No.: US 7,237,461 B1
(45) Date of Patent: Jul. 3, 2007

(54) REVERSE RATCHET WRENCH WITH LIGHT TO INDICATE THE DRIVING ORIENTATION

(75) Inventor: Arthur Wu, Taichung Hsien (TW)

(73) Assignee: Proxene Tools Co., Ltd., Taichung (TW)

( * ) Notice: Subject to any disclaimer, the term of this patent is extended or adjusted under 35 U.S.C. 154(b) by 0 days.

(21) Appl. No.: 11/320,768

(22) Filed: Dec. 30, 2005

(51) Int. Cl.
*B25B 13/46* (2006.01)
*B25B 23/145* (2006.01)

(52) U.S. Cl. ..... 81/63.2; 81/DIG. 5; 173/20

(58) Field of Classification Search ..... 173/20; 116/202, 230, 284, 309
See application file for complete search history.

(56) References Cited

U.S. PATENT DOCUMENTS

2006/0219059 A1* 10/2006 Kageler et al. ..... 81/52

FOREIGN PATENT DOCUMENTS

| | | |
|---|---|---|
| TW | 501519 | 9/2002 |
| TW | 502944 | 9/2002 |

* cited by examiner

*Primary Examiner*—Joseph J. Hail, III
*Assistant Examiner*—Bryan R. Muller
(74) *Attorney, Agent, or Firm*—Birch, Stewart, Kolasch & Birch, LLP

(57) ABSTRACT

A ratchet wrench includes a handle with a head portion at an end thereof, a ratchet wheel mounted in the head portion for rotation, and an operating device to be moved between a first position and a second position for change of a driving orientation of the ratchet wrench. The ratchet wrench of the present invention further provides a light and a battery. The light is turned on when the operating device is moved to the first position and is turned off when the operating device is moved to the second position. User may watch the light signal to identify the driving orientation of the ratchet wrench.

5 Claims, 12 Drawing Sheets

REVERSE RATCHET WRENCH WITH LIGHT TO INDICATE THE DRIVING ORIENTATION

BACKGROUND OF THE INVENTION

1. Field of the Invention

The present invention relates generally to a hand tool, and more particularly to a reverse ratchet wrench, which uses light to indicate the driving orientation of the wrench.

2. Description of the Related Art

Conventional reverse ratchet wrenches have a ratchet wheel, a pawl and a level. User may move the level to move the pawl, and the pawl will be detachably meshed the ratchet wheel at a right or life side, such that the ratchet wrench can turn a bolt (or nut) tight or loose repeatedly in a condition that the wrench engages the bolt (or nut) always.

There is no movement compatibility between the movement of the level and the driving direction of the ratchet wrench, such that user always confuses which direction to move the level when he/she wants to turn loose (or tight). Most of them use try-and-error method, which means user moves the level to one position first and turn the wrench. If it not the driving direction that the user wants than move the level to another position. And user always forgets which way to turn loose and which way to turn tight every time he/she uses the wrench.

Taiwan Pat. Publication No. 502944 disclosed a ratchet wrench having an unsymmetrical head. Taiwan Pat. Publication No 501519 disclosed a wrench with texture, arrow or mark on a side of the handle. Many conventional ratchet wrenches have characters beside the level to indicate the driving direction. It usually puts "R" for release and "L" for lock. But user might misunderstand or miss the meaning of the signs for indication, so that many users will ignore the signs and determine the driving direction by try-and-error.

SUMMARY OF THE INVENTION

The primary objective of the present invention is to provide a ratchet wrench, which provides light signal to indicate the driving direction.

According to the objective of the present invention, a ratchet wrench includes a handle with a head portion at an end thereof, a ratchet wheel mounted in the head portion for rotation, an operating device to be moved between a first position and a second position for change of a driving orientation of the ratchet wrench, and a light to be turned on when the operating device is moved to the first position and to be turned off when the operating device is moved to the second position. User may watch the light signal to identify the driving orientation of the ratchet wrench.

DETAILED DESCRIPTION OF THE INVENTION

Figure 1:
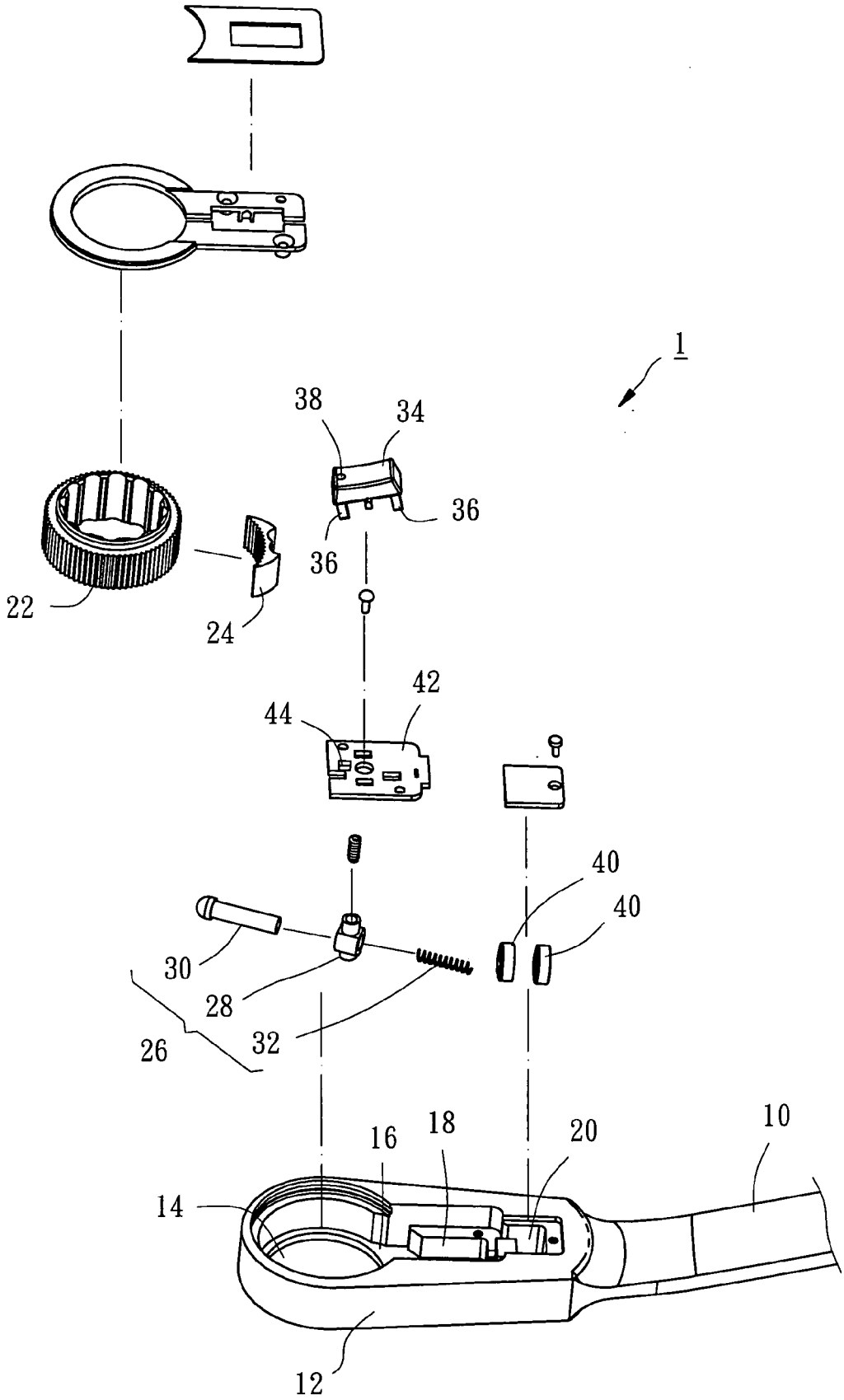
FIG. 1 is an exploded view of a first preferred embodiment of the present invention.
Figure 2:
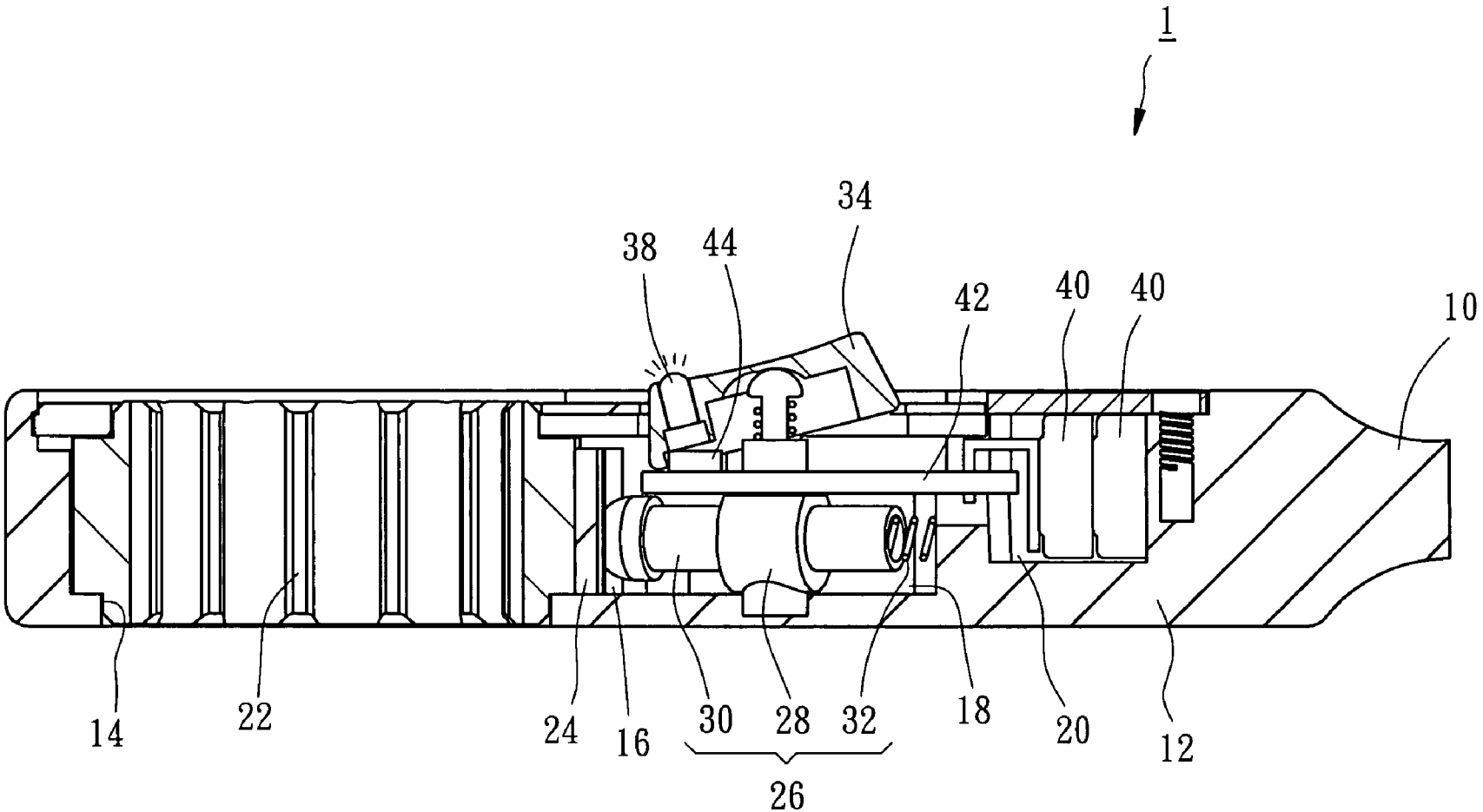
FIG. 2 is a top view of the first preferred embodiment of the present invention, showing the front side of the switch being pressed to turn on the light.

As shown in FIG. 1 and FIG. 2, a ratchet wrench 1 of the first preferred embodiment of the present invention includes a handle 10 with a head portion 12 at an end thereof, on which a first chamber 14, a second chamber 16, a third chamber 18 and a battery chamber 20 are provided. The first, second and third chambers 14, 16 and 18 are communicated with each other, and the second chamber 16 is between the first chamber 14 and the third chamber 18.

A ratchet wheel 22 is received in the first chamber 14 of the handle 10 for free rotation.

A pawl 24 is received in the second chamber 16 to be moved to a right or left of the second chamber 16. The pawl 24 is able to be meshed and unmeshed with the ratchet wheel 22.

A switching device 26 is mounted in the third chamber 18 having a base 28, a driving member 30 and a spring 32. The driving member 30 has an end against the pawl 24 to move the pawl 24 to the right or left of the second chamber 16.

An operating device 34, which is a switch in the embodiment, is mounted above the switching device 24. The operating device 34 has two triangle blocks 36 at a bottom thereof. The operating device 34 can be pressed at a front and a rear respectively. When the front of the operating device 34 is pressed, the block 36 at the front moves the switching device for clockwise rotation to move the pawl 24 to the right of the second chamber 16, and when the rear of the operating device 34 is pressed, the rear block 36 will move the switching device 26 for counterclockwise rotation to move the pawl 24 to the left of the second chamber 16. When the front of the operating device 34 is pressed, the ratchet wrench 1 is able to turn a nut (or a bolt) tight, and when the rear in touch with the switching device 26 of the operating device 34 is pressed, the ratchet wrench 1 is able to turn a nut (or a bolt) loose.

A light 38, which is a light emitting diode (LED) in the present invention, is mounted on the front of the operating device 34.

Two batteries 40 are received in the battery chamber 20 and electrically connected to a circuit board 42. The circuit board 42 is in the third chamber 18 between the switching device 26 and the operating device 34. The circuit board 42 has an electrode 44 to be in touch with the light 38 to light the light 38 when the front of the operating device 34 is pressed. The light 38 will be turned off when the rear of the operating device 34 is pressed.

Figure 3:
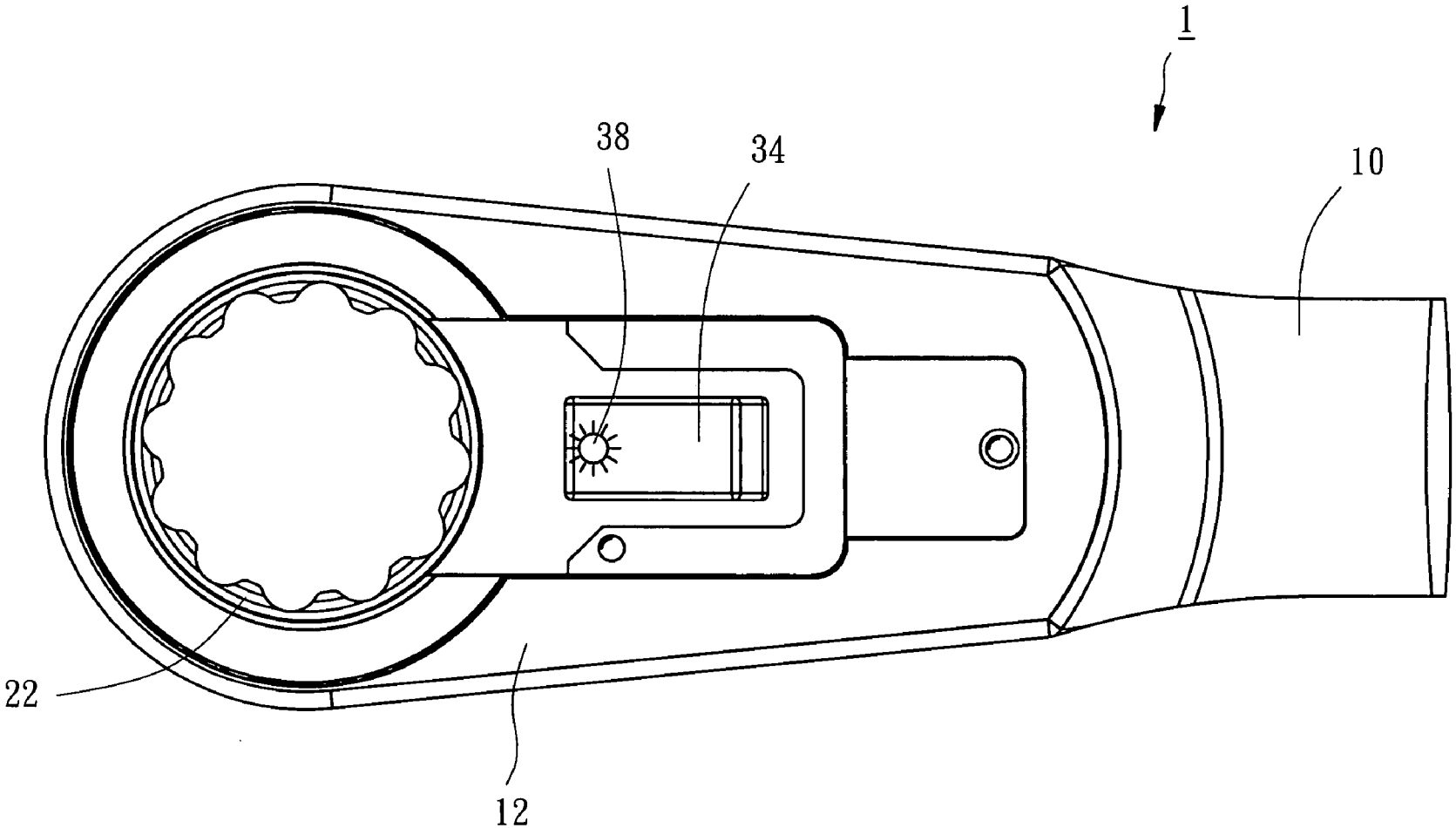
FIG. 3 is a sectional view of FIG. 2.
Figure 4:
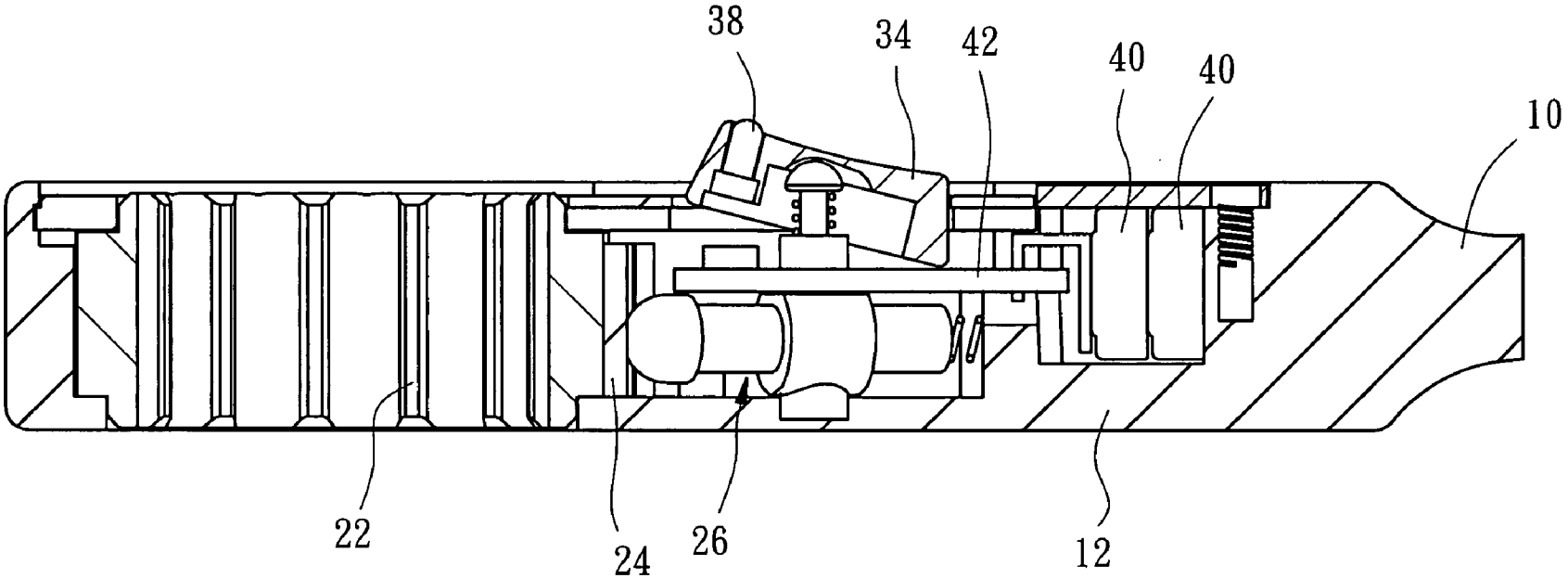
FIG. 4 is a top view of the first preferred embodiment of the present invention, showing the rear side of the switch being pressed to turn off the light.
Figure 5:
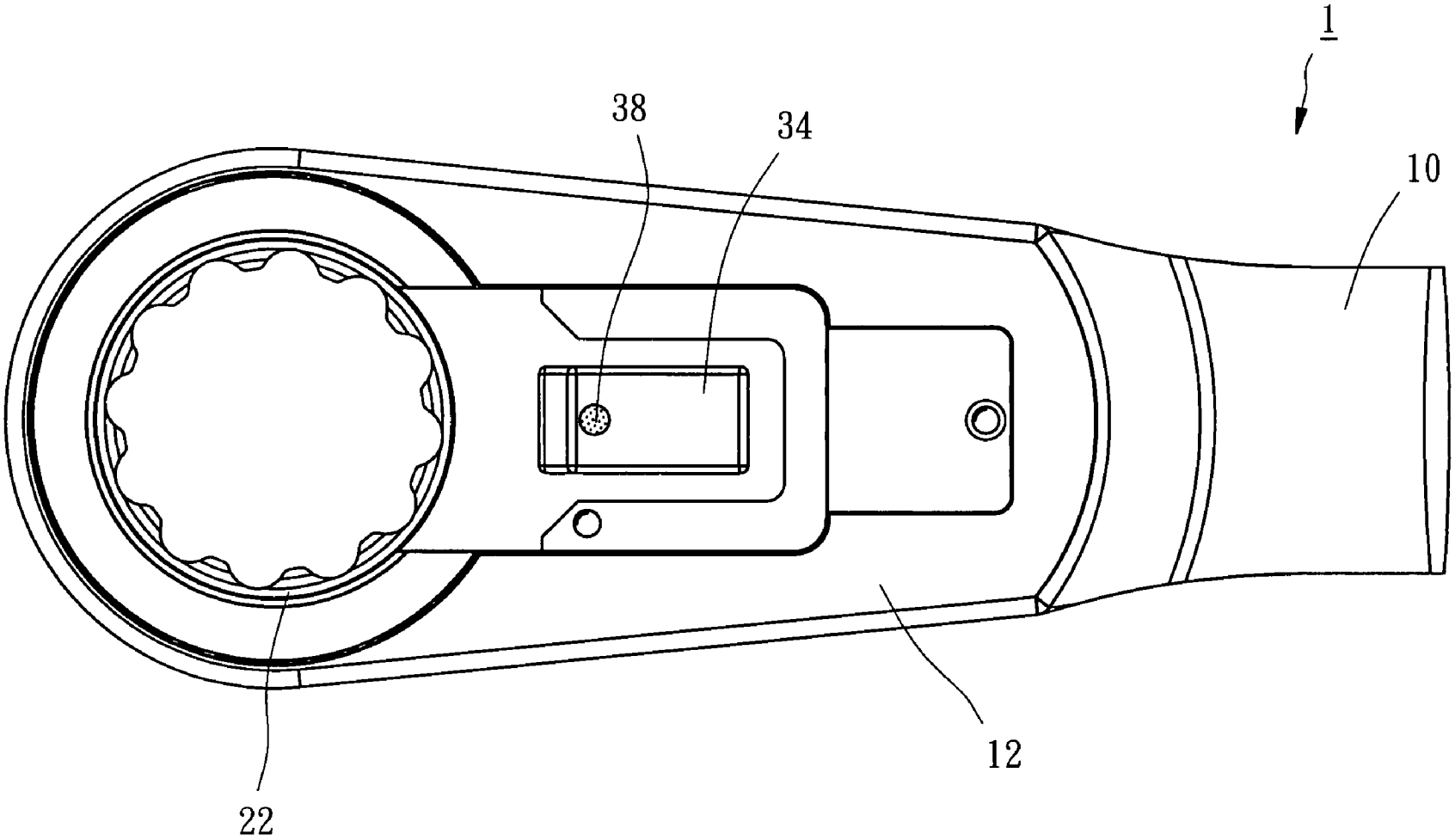
FIG. 5 is a sectional view of FIG. 4.
Figure 6:
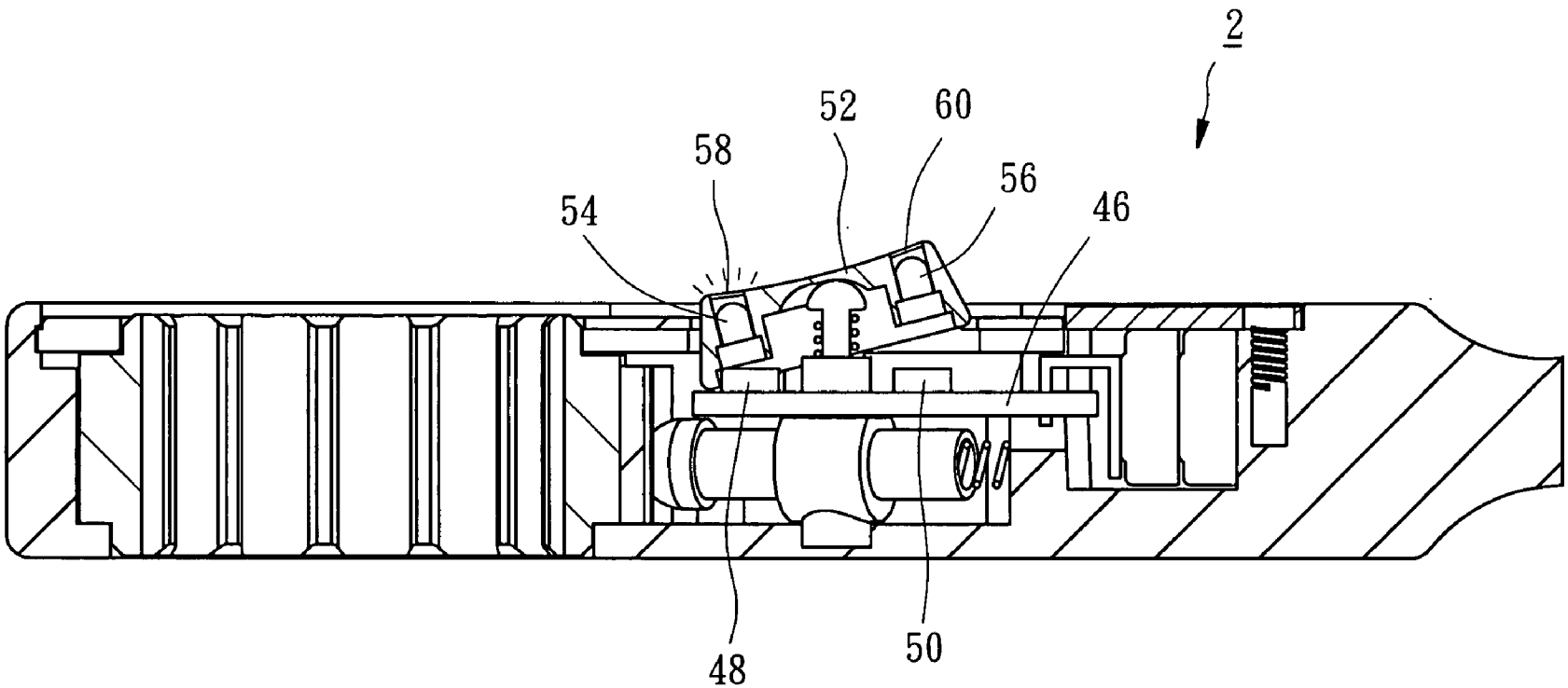
FIG. 6 is a sectional view of a second preferred embodiment of the present invention, showing the front side of the switch being pressed to turn on the light.
Figure 7:
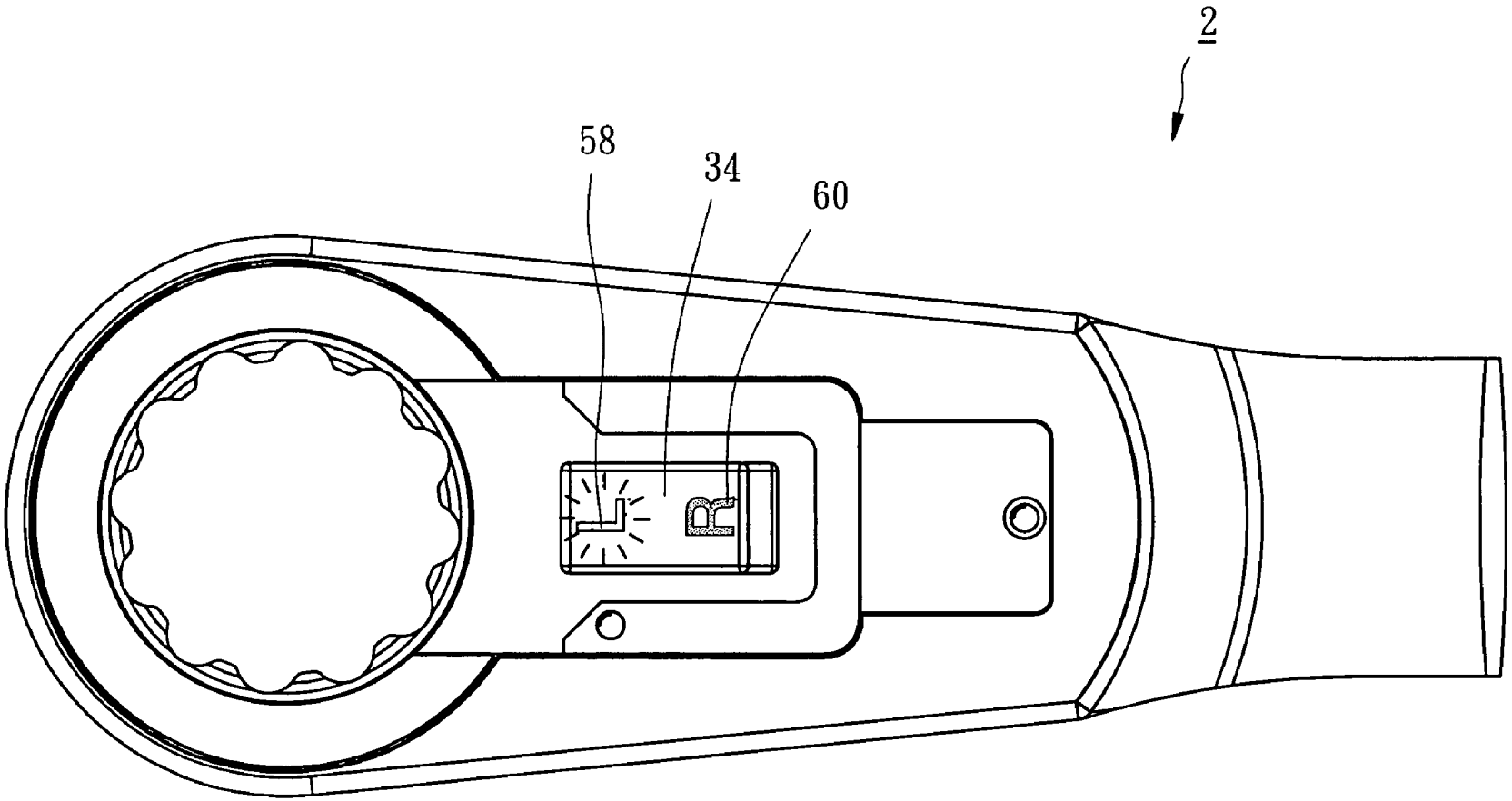
FIG. 7 is a top view of FIG. 6.
Figure 8:
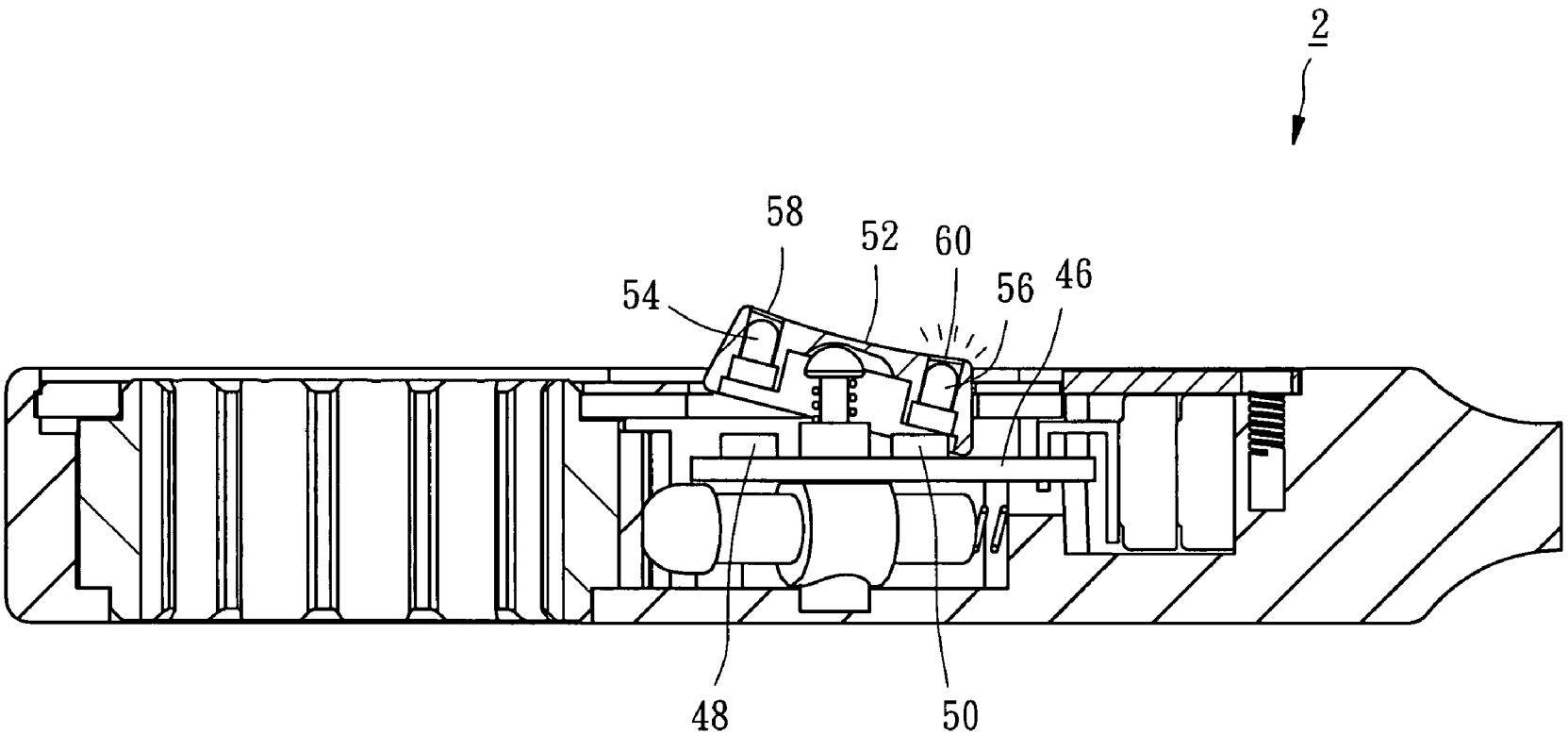
FIG. 8 is a sectional view of the second preferred embodiment of the present invention, showing the rear side of the switch being pressed to turn on the second light.
Figure 9:
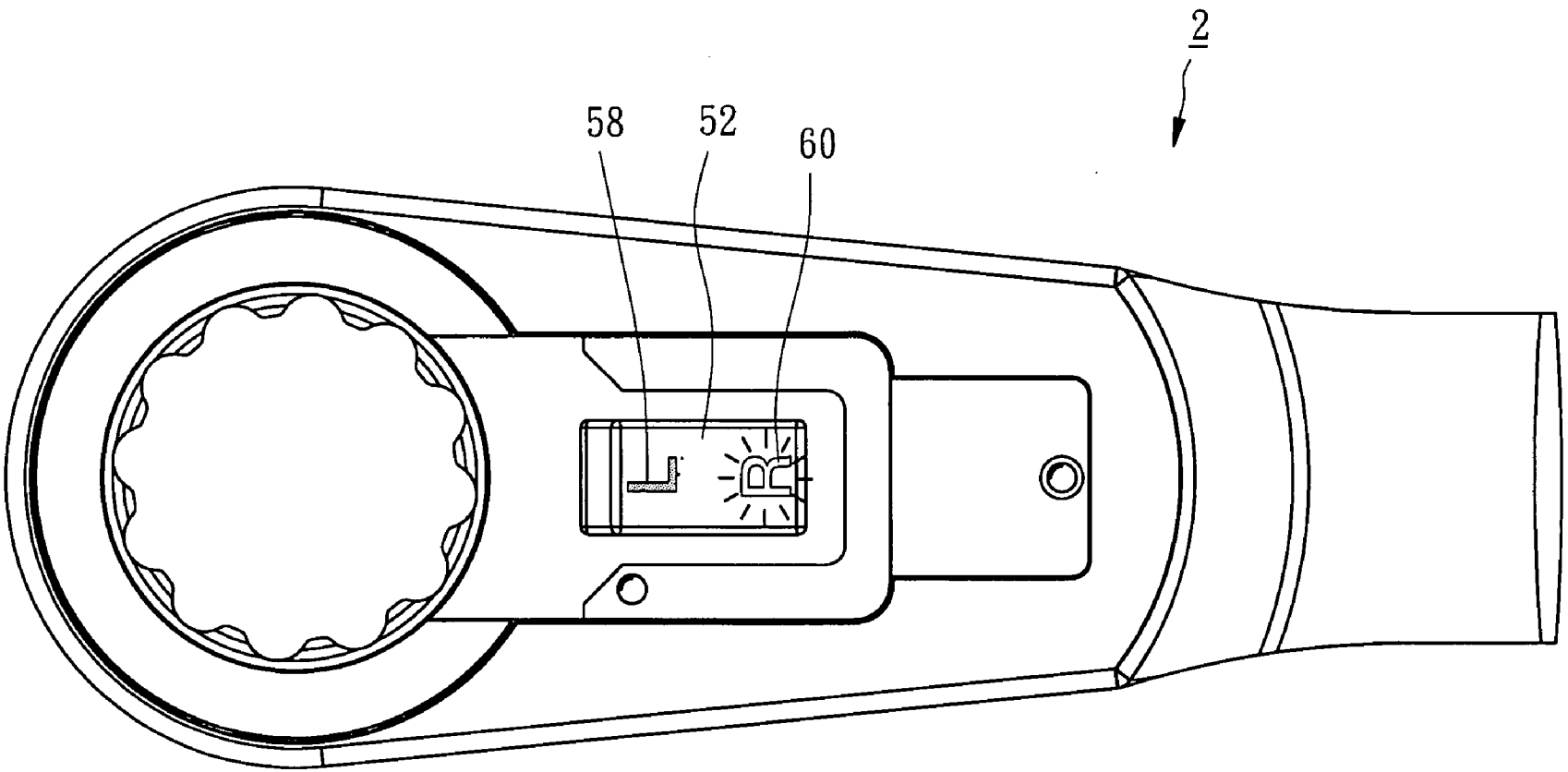
FIG. 9 is a top view of FIG. 8.

As a result, when the user presses the operating device 34 with the light 38 on (referring to FIG. 2 and FIG. 3), he/she will know the ratchet wrench 1 is able to drive the nut or blot tight, and when the user presses the operating device 34 with the light 38 off (referring to FIG. 4 and FIG. 5), he/she will know the ratchet wrench 1 is able to drive the nut or blot loose.

As shown in FIG. 6 to FIG. 9, a ratchet wrench 2 of the second preferred embodiment of the present invention, which is similar to the wrench 1 of the first preferred embodiment, except that the circuit board 46 has two electrodes 48 and 50. The operating device 52 has two lights 54 and 56 associated with the electrodes 48 and 50 respectively. The operating device 52 is provided with two indication portions 58 and 60 above the lights 54 and 56, which are a red "L" and a green "R". As a result, the light 54 at the front will be lighted and user will see a lighting red "L" on the operating device 52 when the front of the operating device 52 is pressed, and the light 56 at the rear will be lighted and user will see a lighting green "R" on the operating device 52 when the rear of the operating device 52 is pressed. When the user sees a lighting red "L", it means the ratchet wrench 2 is in a condition of driving a nut tight (L means "lock"), and when user sees a lighting green "R", it means the ratchet wrench 2 is in a condition of driving a nut loose (R means "release"). Light will attract the user's attention that the user is hard to miss the message. The color of the light will be a redundant signal that the user may tell the driving orientation by the color as well.

The main character of the present invention is light, including light ON/OFF, lighting icon and color of light. The light will catch user attention to show the driving orientation of the ratchet wrench. The technique of the present invention may be incorporated into any type of ratchet wrench.

Figure 11:
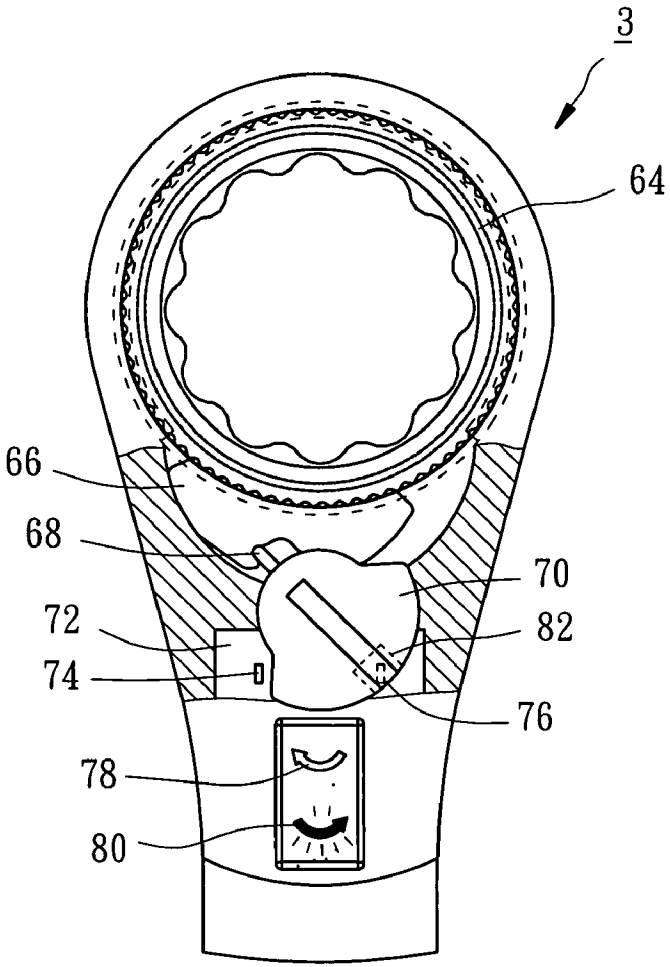
FIG. 10 and FIG. 11 are top views of a third preferred embodiment of the present invention.
Figure 10:
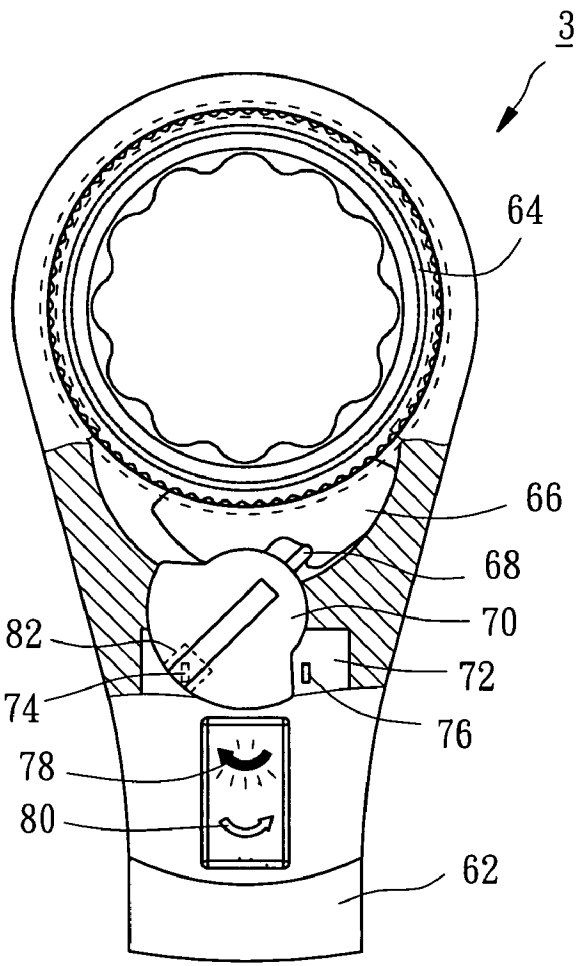

FIG. 10 and FIG. 11 show a ratchet wrench 3 of the third preferred embodiment of the present invention, which includes a handle 62, a ratchet wheel 64, a pawl 66, a switching device 68 and an operating device 70. The operating device 70 is a lever to be moved between a first position (FIG. 10) and a second position (FIG. 11). The movement of the operating device 70 will turn the switching device 68 and move the pawl 66 to the right or left. Above components are as same as the conventional ratchet wrench, so 1 would not describe the detail.

A circuit board 72 is mounted in the handle 62 having a first electrode 74 and a second electrode 76. The handle 62 has two indication portions 78 and 80, under each of which a light (not shown) is provided. The indication portions 78 and 80 are two arrows pointing opposite directions and have different colors as above. The operating device 70 has a starting member 82 to be in touch with the first electrode 74 or the second electrode 76 when the operating device 70 is moved to the first position or the second position. As a result, when the operating device 70 is moved to the first position, the light under the indication portion 78 is lighted to show the user a lighting red arrow, and the arrow points the driving orientation, which tells user to tighten a bolt or nut, of the ratchet wrench 3 of the present invention. On the contrary, when operating device 70 is moved to the second position, the light under the indication portion 8 is lighted to show the user a lighting green arrow, which tells user to loose a bolt or nut.

Figure 13:
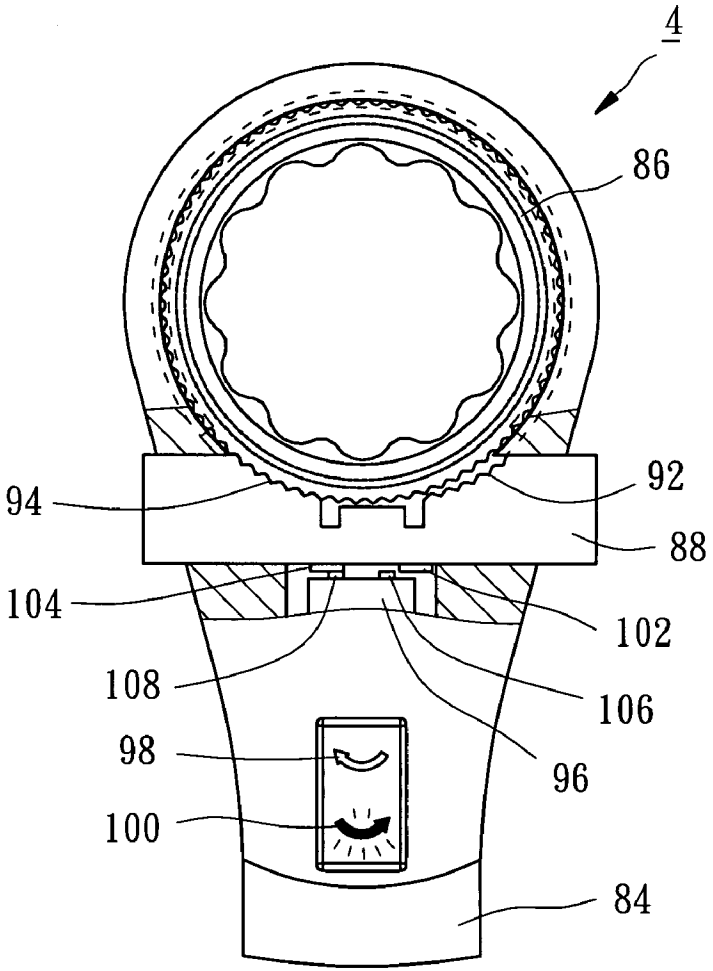
FIG. 12 and FIG. 13 are top views of a fourth preferred embodiment of the present invention.
Figure 12:
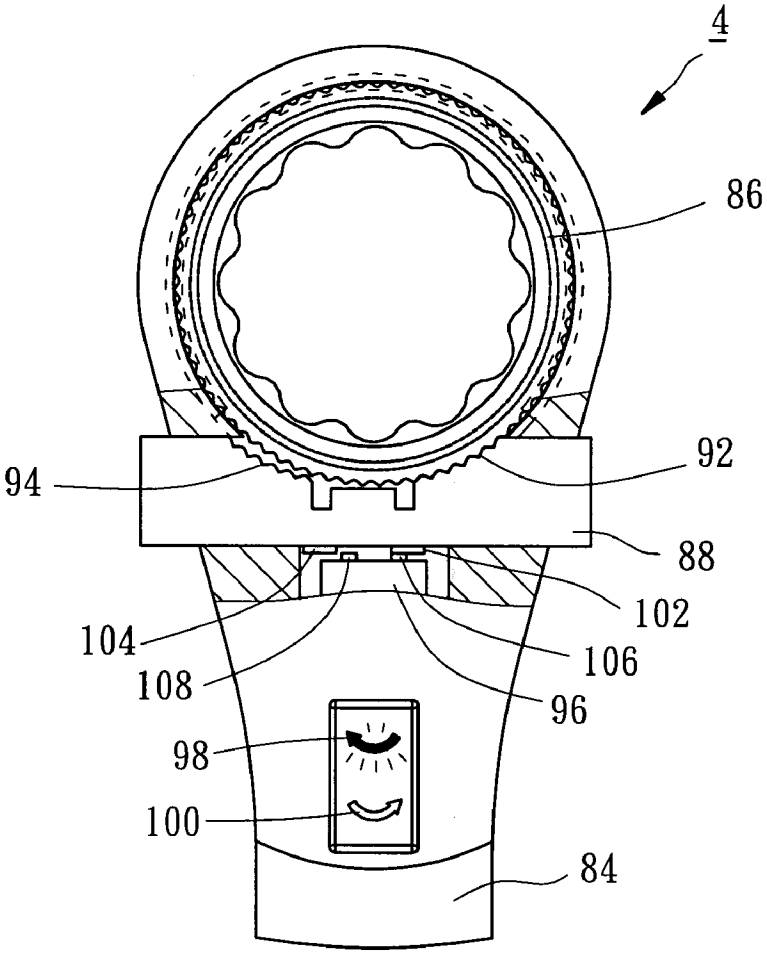

FIG. 12 and FIG. 13 show a ratchet wrench 4 of the fourth preferred embodiment of the present invention. The wrench structure of the ratchet wrench 4 of the present invention is as same as the conventional ratchet wrench including a handle 84, a ratchet wheel 86 and an operating device 88. The operating device 88 is received in a transverse hole 90 of the handle 84, which has two pawl portions 92, 94 at a center. As a result, the right pawl portion 92 will be meshed with the ratchet 86 when the operating device 88 is moved to left (referring to FIG. 12) to tight a nut, and the left pawl portion 94 will be meshed with the ratchet 86 when the operating device 88 is moved to right (referring to FIG. 13) to loose a nut.

The ratchet wrench 4 of the present invention further includes battery (not shown), a circuit board 96 and two lights (not shown). The handle 84 is provided with two indication portions 98, 100, under which are the lights. The operating device 88 has two starting members 102, 104, associated with which are two electrodes 106, 108 on the circuit board 96. The light under the indication portion 98 will be lighted when the operating device 88 is moved to left to contact the starting member 102 with the electrode 106 (referring to FIG. 12), such that user will see a lighting red arrow. On the contrary, the light under the indication portion 100 will be lighted when the operating device 88 is moved to right to contact the starting member 104 with the electrode 108 (referring to FIG. 13), such that user will see a lighting green arrow pointing to another direction.

In conclusion, the present invention provides lights on the conventional ratchet wrench. When the operating device is moved to change the driving orientation, the light will be turned on or turned off to tell user the driving orientation of the ratchet wrench. Light signal will attract user's attention, they won't miss the signal. In addition, the present invention further provides pattern and color of the light as the redundant signal to help user.

Figure 15:
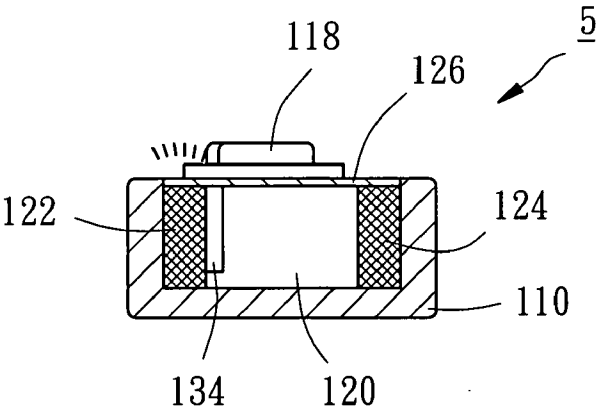
FIG. 15 and FIG. 16 are sectional views along the 15—15 line of FIG. 14.
Figure 16:
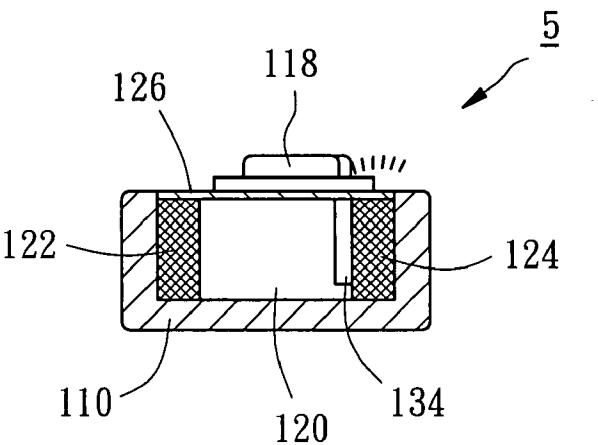
Figure 14:
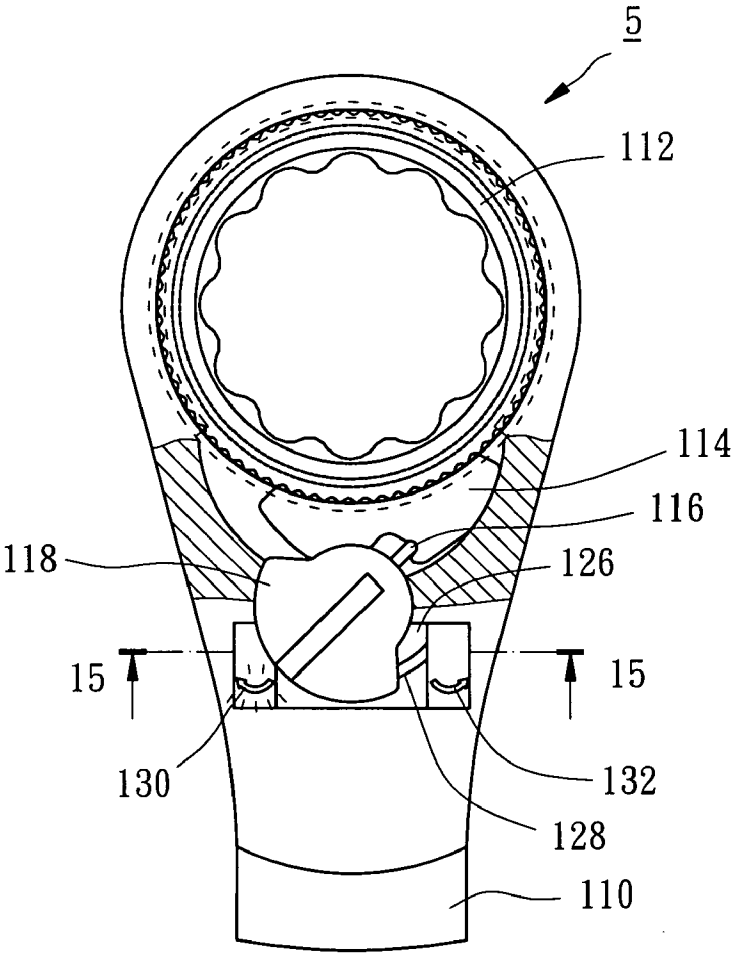
FIG. 14 is a sectional view of a fifth preferred embodiment of the present invention.

As shown in FIG. 14 to FIG. 16, a ratchet wrench 5 of the fifth preferred embodiment of the present invention includes a handle 110, a ratchet wheel 112, a pawl 114, a switching device 116 and an operating device 118. The handle 110 has a slot 120, in which two light emitting members 122, 124 are provided at opposite ends thereof. The light emitting members are made of a material, which emits light when it is pressed. A lid 126 fixed to the handle 110 to close the slot 120, on which an arched guiding opening 128 is provided. The lid further has two indication portions 130, 132 above the light emitting members 122, 124 respectively. The operating device 118 has a protrusion 134 inserted into the slot 120 via the guiding opening 128 of the lid 126. When the operating device 118 is moved to a first position, as shown in FIG. 15, the protrusion 134 will presses the right light emitting member 122 to make it lighting. On the contrary, when the operating device 118 is moved to a second position, as shown in FIG. 16, the protrusion 134 will presses the left light emitting member 124 to make it lighting.

What is claimed is:

1. A ratchet wrench, comprising a handle with a head portion at an end thereof, a ratchet wheel mounted in the head portion for rotation, an operating device to be moved between a first position and a second position for change of a driving orientation of the ratchet wrench, a circuit board with an electrode and a battery electrically connected to the circuit board, and a light which is turned on when the operating device is moved to the first position and is turned off when the operating device is moved to the second position wherein the light is electrically connected to the circuit board, and the operating device has a starting member, whereby the starting member contacts the electrode when the operating device is moved to the first position, and the starting member leaves the electrode when the operating device is moved to the second position.

2. The ratchet wrench as defined in claim 1, further comprising a second light, which is turned off when the operating device is moved to the first position and is turned on when the operating device is moved to the second position.

3. The ratchet wrench as defined in claim 1, wherein the light is provided on the handle.

4. The ratchet wrench as defined in claim 1, wherein the ratchet wrench is provided with an indication portion associated with the light, and the indication portion has a predetermined pattern to let light provided from the light traveling through.

5. The ratchet wrench as defined in claim 1, wherein the ratchet wrench is provided with an indication portion associated with the light, and the indication portion has a predetermined color to let light provided from the light traveling through.

* * * * *